US008705748B2

(12) United States Patent
Walsh

(10) Patent No.: US 8,705,748 B2
(45) Date of Patent: Apr. 22, 2014

(54) METHOD FOR SPATIALLY PROCESSING MULTICHANNEL SIGNALS, PROCESSING MODULE, AND VIRTUAL SURROUND-SOUND SYSTEMS

(75) Inventor: Martin Walsh, Scotts Valley, CA (US)

(73) Assignee: Creative Technology Ltd, Singapore (SG)

( * ) Notice: Subject to any disclaimer, the term of this patent is extended or adjusted under 35 U.S.C. 154(b) by 1270 days.

(21) Appl. No.: 11/800,349

(22) Filed: May 4, 2007

(65) Prior Publication Data

US 2008/0273721 A1 Nov. 6, 2008

(51) Int. Cl.
*H04R 5/00* (2006.01)

(52) U.S. Cl.
USPC ..... 381/17; 307/123; 307/303; 307/61

(58) Field of Classification Search
USPC ..... 381/1, 17–26, 61, 63, 74, 309, 310, 381/119–120, 27, 13, 311, 317, 318, 71.14, 381/86, 89, 332, 94.5, 97, 98, 99, 111, 182, 381/300–307, 92, 122, 337, 186, 11, 12, 28, 381/5, 6, 77, 80, 81, 82, 85, 333, 334, 118, 381/123; 700/94
See application file for complete search history.

(56) References Cited

U.S. PATENT DOCUMENTS 6,016,473 A * 1/2000 Dolby ..... 704/500
6,311,155 B1 * 10/2001 Vaudrey et al. ..... 704/225
6,771,778 B2 8/2004 Kirkeby
6,956,954 B1 * 10/2005 Takemura et al. ..... 381/307
7,082,201 B2 * 7/2006 Sotome et al. ..... 381/17
7,177,431 B2 2/2007 Davis et al.
7,835,535 B1 * 11/2010 Trautmann et al. ..... 381/310
2003/0185400 A1 * 10/2003 Yoshizawa et al. ..... 381/58
2005/0141723 A1 * 6/2005 Lee et al. ..... 381/26
2006/0115091 A1 * 6/2006 Kim et al. ..... 381/18

FOREIGN PATENT DOCUMENTS

JP 2005198049 A * 7/2005

OTHER PUBLICATIONS

Lorho et al "Efficient HRTF Synthesis Using an Interaural Transfer Function Model", Nokia Research Center, Speech and Audio Systems Laboratory, 2000, pp. 1-4.*
Lorho, Gaetan , et al., "Efficient HRTF synthesis using an interaural transfer function model", *Proc. EUSIPCO*'2000, Tampere, Finland, Sep. 5-8, 2000,4 pgs.

* cited by examiner

*Primary Examiner* — Leshui Zhang
(74) *Attorney, Agent, or Firm* — Schwegman Lundberg & Woessner, P.A.

(57) ABSTRACT

Embodiments of a virtual surround-sound system and methods for simulating surround-sound are generally described herein. Other embodiments may be described and claimed. In some embodiments, a processing module may include spatial processor spatially processes surround-left and surround-right channel signals and front-left and front-right channel signals and combines the spatially-processed signals for providing to drivers of center speaker after crosstalk cancellation and combining with a center-channel signal. In some embodiments, the processing module may include circuitry to cause the spatial processor to refrain from spatially processing either the front-left and front-right channel signals when front-left and/or front-right speakers are connected.

16 Claims, 3 Drawing Sheets

METHOD FOR SPATIALLY PROCESSING MULTICHANNEL SIGNALS, PROCESSING MODULE, AND VIRTUAL SURROUND-SOUND SYSTEMS

TECHNICAL FIELD

Some embodiments of the present invention pertain to audio systems. Some embodiments pertain to surround-sound systems.

BACKGROUND

Multichannel audio systems, such as those in home theater systems, allow consumers to experience surround-sound in their homes. One issue with these multichannel audio systems is that they are difficult to set up due to the number of speakers, the wiring associated with each of the speakers, and the positioning requirements of the speakers. To reduce set-up complexity, some multichannel audio systems use a lower number of speakers and attempt to simulate the location of the sound source using, for example, reflections off walls. The performance of these systems, however, may be significantly compromised by the specific room environment, among other factors.

Thus, there are general needs for multichannel audio systems and methods that provide a surround-sound experience. There are also needs for multichannel audio systems and methods that provide a surround-sound experience with reduced set-up complexity and less sensitivity to the particular listening environment.

DETAILED DESCRIPTION

The following description and the drawings sufficiently illustrate specific embodiments of the invention to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in, or substituted for those of other embodiments. Embodiments of the invention set forth in the claims encompass all available equivalents of those claims. Embodiments of the invention may be referred to herein, individually or collectively, by the term "invention" merely for convenience and without intending to limit the scope of this application to any single invention or inventive concept if more than one is in fact disclosed.

The introduction of digital video disc (DVD) players into the living room has greatly increased consumer interest in multichannel audio and the 'home theater' experience. Many users may find the practical complexities associated with setting up a multi-speaker system prohibitive. Several new surround-sound products have been introduced to simplify the set-up process. Some of these products use '3D audio' techniques to present the auditory perception of virtual loudspeakers where there are none physically present. These products can be categorized as either a 1.1 or a 2.1 virtual surround speaker system, where the prefix represents the number of speaker units (as opposed to speaker drivers) used in the system and the suffix represents the '0.1' subwoofer channel. In these systems, the main speaker drivers are generally used to generate a virtual-surround-soundfield around the listener.

Some of these 1.1 virtual surround-sound systems use two closely-spaced speakers in a single center channel unit to generate sound for the virtual speakers. One issue with some of these 1.1 virtual surround-sound systems are the timbre and spatial mismatches compared to the original content played over real speakers. This is particularly significant for the front loudspeakers, where the majority of musical reproduction takes place. 2.1 virtual surround-sound systems, which usually leave the front-left and right channels intact, suffer from poor center channel stability, a small listening sweetspot and stringent speaker spacing and/or listening distance requirements.

Figure 1:
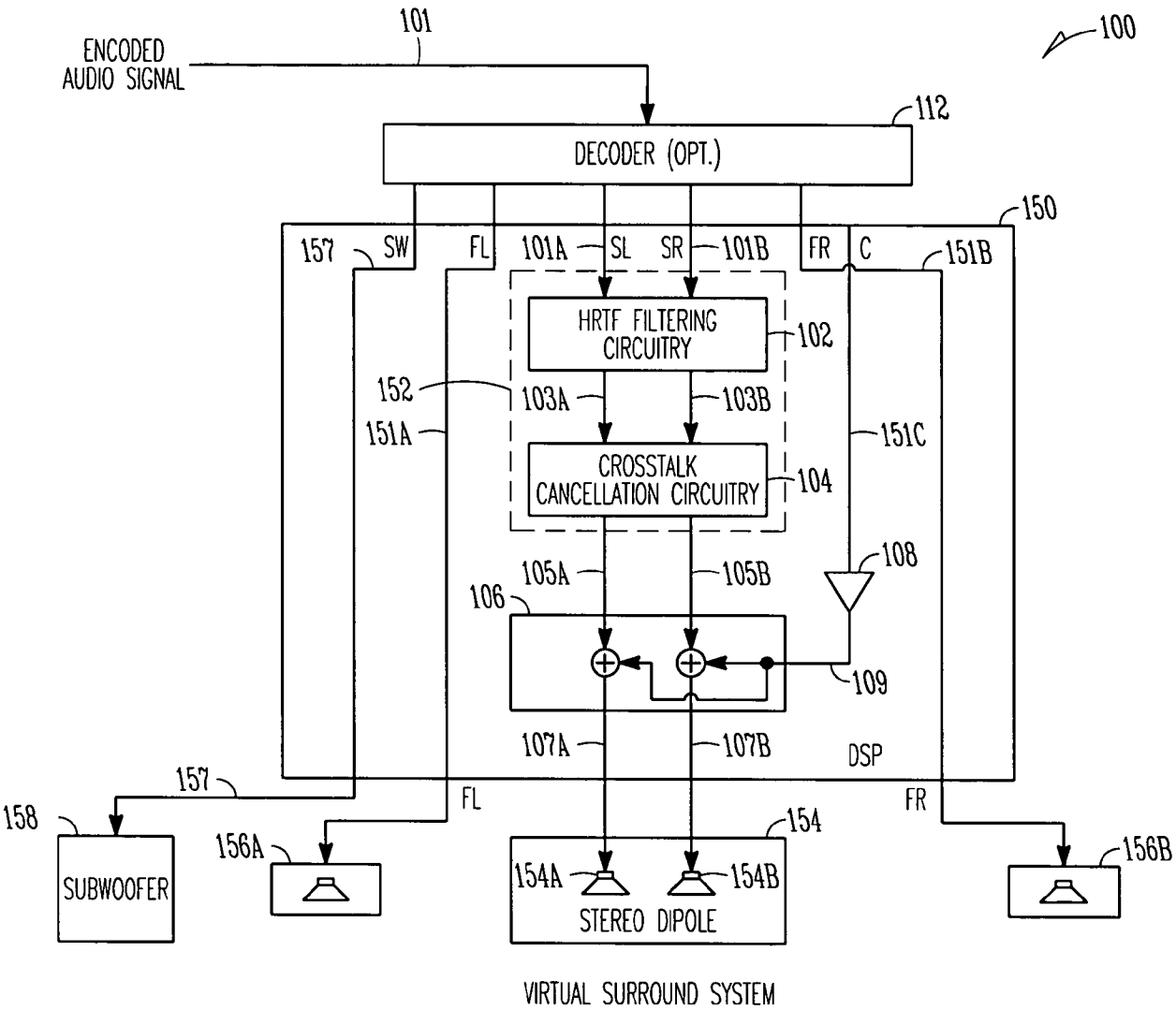
FIG. 1 is a block diagram of a virtual surround-sound system in accordance with some embodiments of the present invention.

Some embodiments of the present invention are directed to a processing module suitable for use in a 3.1 virtual surround-sound system in which surround-right and surround-left channels are spatially processed. Separate drivers of a center speaker together provide virtualized surround-right and surround-left audio after crosstalk cancellation. In these embodiments, center-channel stability may be increased, the listening sweetspot may be increased, and the speaker spacing and/or listening distance requirements may be less stringent. These embodiments are illustrated in FIG. 1 and are described in more detail below.

Figure 4:
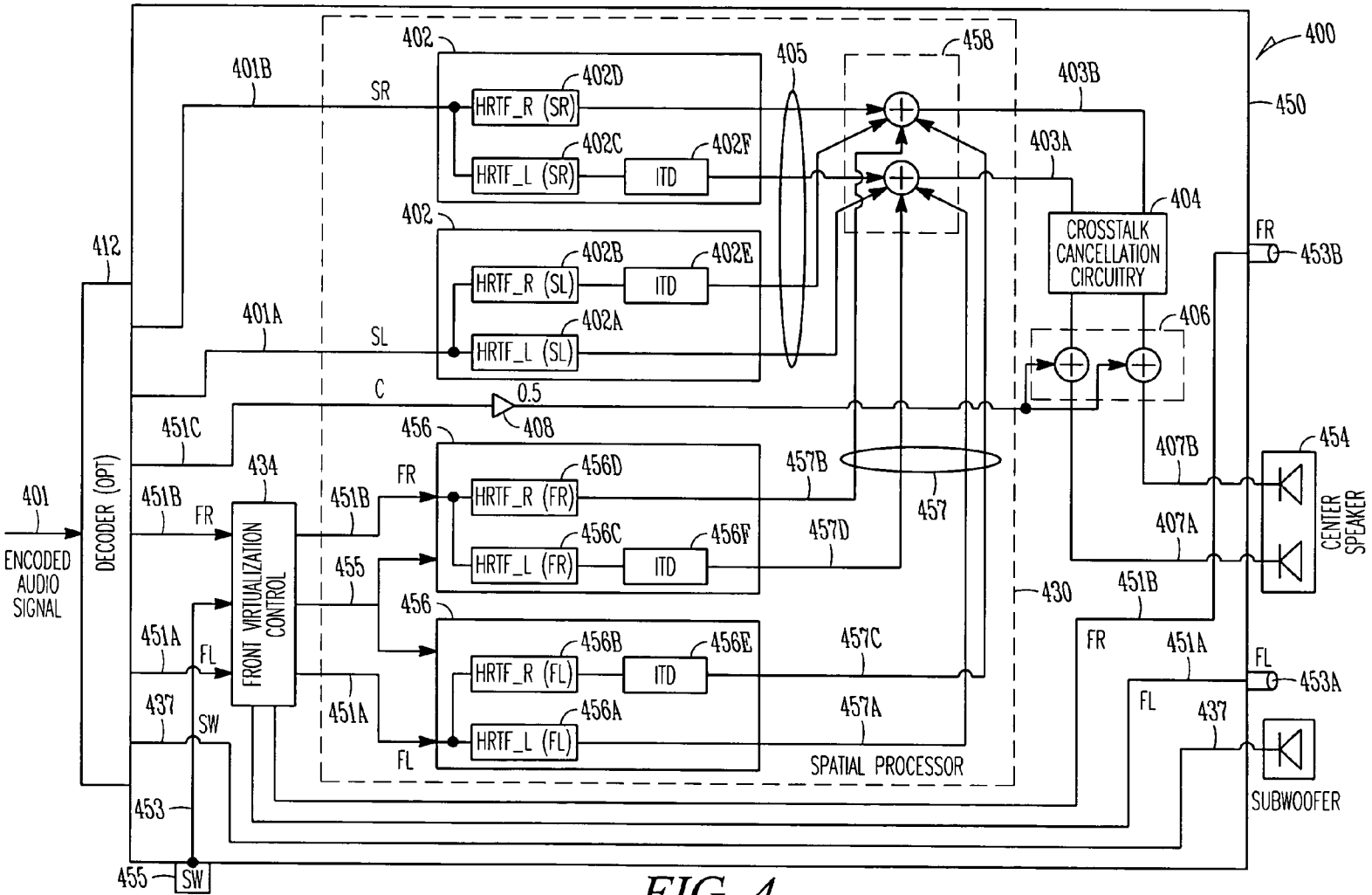
FIG. 4 is a block diagram of a virtual surround-sound system in accordance with some embodiments of the present invention.

Some other embodiments of the present invention are directed to a processing module suitable for use in a virtual surround-sound system that may operate either as a 1.1 virtual surround-sound system or a 3.1 virtual surround-sound system. In some of these embodiments, the processing module may automatically convert between a 1.1 virtual surround-sound system and a 3.1 virtual surround-sound system depending on whether front-left and front-right speakers are used. In these embodiments, the timbre and spatial mismatches may be reduced as compared to some conventional 1.1 virtual surround-sound system, and center-channel stability may be increased, the listening sweetspot may be increased, and the speaker spacing and/or listening distance requirements may be less stringent as compared to some conventional virtual surround-sound systems. These embodiments are illustrated in FIG. 4 and are described in more detail below.

In some embodiments, a signal processing module accepts multichannel inputs and provides between two and four output channels. In some embodiments, the output channels may be directed to a left speaker, a right speaker, and a center channel speaker. The center channel speaker may have an array of two or more speaker drivers that can be independently driven. The left and right output channels may be directed to the left and right speakers. The center channel may be directed equally to each of the speaker drivers of the array. In some embodiments, the surround channels may be spatially processed by the processing model and virtualized via playback over the center channel array. In other embodiments, the left and right loudspeakers can be removed and the front-left and front-right channels may be spatially processed and virtualized via playback over the center channel array.

In some embodiments, when operating as a 3.1 virtual surround-sound system, the left, right and center channels may be preserved and the surround channels may be virtualized. These embodiments may provide some advantages of both 1.1 and 2.1 virtual surround-sound systems. If a user chooses to remove (or not connect) speakers for the front-left and front-right channels, the front-left and front-right channels may be virtualized over the center speaker driver array. This modular system design may provide advantages for a system provider allowing a virtual surround-sound system to be sold in a single upgradeable configuration. In this way, a consumer that buys a 1.1 virtual surround-sound system may later add on an additional pair of speakers to enable a 3.1 virtual surround-sound system. This may reduce the number of product variations required to facilitate different consumer requirements. These embodiments are discussed in more detail below.

FIG. 1 is a block diagram of a virtual surround-sound system in accordance with some embodiments of the present invention. Virtual surround-sound system 100 virtualizes the surround channels of a multichannel signal to provide a surround-sound experience without separate surround-channel speakers. In some embodiments, the multichannel signal may comprise surround-left (SL) channel signal 101A, surround-right (SR) channel signal 101B, front-left (FL) channel signal 151A, front-right (FR) channel signal 151B, and center-channel signal 151C. In some embodiments, the multichannel signal may further comprise subwoofer (SW) channel signal 157. In some embodiments, the multichannel signal may be generated by decoder 112 from encoded audio signal 101. Virtual surround-sound system 100 may be viewed as a 3.1 virtual system in which the '3' represents the number of separate speakers and the '0.1' represents the subwoofer channel.

In some embodiments, virtual surround-sound system 100 comprises processing module 150 to spatially process surround channels signal 101A & 101B, and to combine the spatially processed surround channels with center-channel signal 151C, for playing by an array of drivers of center speaker 154. Processing module 150 may comprise spatial processor 152 to spatially process surround-left channel signal 101A and surround-right channel signal 101B. Processing module 150 may also comprise signal combining circuitry 106 to add spatially-processed surround channel signals 105A & 105B to center-channel signal 151C to generate spatially-processed signals 107A & 107B for drivers of center speaker 154. Front-left and front-right channel signals 151A & 151B may be provided unchanged or unprocessed to front-left and front-right speakers 156A & 156B respectively.

In these embodiments, center speaker 154 operates as a center-channel speaker and as a means of providing virtual right and virtual left surround channels. This may help preserve the content of the center channel while eliminating the requirement for separate surround channel speakers. In some embodiments, center speaker 154 may comprise two or more speaker drivers, such as speaker driver 154A and speaker driver 154B. Speaker driver 154A may be coupled to spatially-processed signal 107A and speaker driver 154B may be coupled to spatially-processed signal 107B. Both speaker drivers 154A and 154B together generate sound for virtualizing the right and left surround channels, as well as generate sound for the center channel.

In some embodiments, encoded audio signal 101 may be provided by a DVD player, a high-definition (HD) DVD player, a BluRay player, a set-top-box, a game console (e.g., an Xbox360 or a PlayStation3), a personal computer, a high-definition television (HDTV) receiver, a cable television system, and/or or satellite television system, although the scope of the invention is not limited in this respect. In some embodiments, encoded audio signal 101 may be provided from a multichannel audio file (e.g., from a storage element such as a disk or memory), although the scope of the invention is not limited in this respect. In other embodiments, encoded audio signal 101 may be an analog signal and may be converted to multichannel digital signals by analog-to-digital conversion circuitry, although the scope of the invention is not limited in this respect.

In some embodiments, center speaker 154 may be a stereo-dipole speaker in which speakers drivers 154A & 154B are adjacent to each other and separated by a closely-spaced distance. Speaker drivers 154A & 154B may be directed in a forward direction to achieve better crosstalk cancellation and virtualization of surround-left and surround-right channel signals 101A & 101B. In these embodiments, center speaker 154 may be intended for placement between front-left speaker 156A and front-right speaker 156B. Although center speaker 154 is illustrated with only two speaker drivers, center speaker 154 may comprise an array of more than two speaker drivers. In some embodiments, center speaker 154 may comprise an array of up to ten or more speaker drivers.

In some embodiments, processing module 150 may also comprise amplifier 108 to reduce a signal level of center-channel signal 151C and to provide center-channel signal 109 with a reduced signal level to signal combining circuitry 106 for adding to spatially-processed surround channel signals 105A & 105B. Amplifier 108 may have a gain of less than one. In some embodiments, amplifier 108 may have gain of about 0.5 to help retain the volume level of center-channel signal 151C relative to spatially-processed surround channel signals 105A & 105B, although the scope of the invention is not limited in this respect. In some embodiments, instead of amplifier 108, digital divide-by-two circuitry may be used, although the scope of the invention is not limited in this respect.

In some embodiments, spatial processor 152 may include head-related transfer function (HRTF) filtering circuitry 102 to perform HRTF filtering on surround-left and surround-right channel signals 101A & 101B. HRTF filtering circuitry 102 may generate spatially-processed surround channel signals 103A & 103B which may simulate a perception that a sound source is behind a listener. Spatial processor 152 may also include crosstalk cancellation circuitry 104 to reduce and/or substantially cancel crosstalk. In some embodiments, spatially-processed surround channel signals 103A & 103B may simulate the perception that the sound source is behind the listener for a predetermined listener location, and crosstalk cancellation circuitry 104 may reduce and/or substantially cancel crosstalk from signals 103A & 103B for the predetermined listener location. The predetermined listener location may be viewed as a sweet spot or sweet region. These embodiments are discussed in more detail below.

Accordingly, virtual surround-sound system 100 may provide a surround-sound experience with a lower number of speakers than some conventional surround-sound systems (e.g., 5.1 systems). Virtual surround-sound system 100 may also provide a surround-sound experience with reduced set-up complexity and less sensitivity to the particular the listening environment. The sweet spot or sweet region of virtual surround-sound system 100, at least for the surround channels, may be wider than many conventional 1.1 and 2.1 virtual surround-sound systems due, at least in part to the close proximity of drivers 154A & 154B.

Decoder 112 may generate a multichannel input for processing module 150 from encoded audio signal 101. Encoded audio signal 101 may comprise perceptually encoded and/or compressed audio, such as an MP3 encoded signal. Decoder 112 may decode and/or expand encoded audio signal 101 to generate surround-left and surround-right channel signals 101A & 101B, front-left and front-right channel signals 151A & 151B, center-channel signal 151C, and/or subwoofer signal 157. In some embodiments, encoded audio signal 101 may be in a digital theater system (DTS) format, a Dolby format, or another format. In some embodiments, decoder 112 may detect the format of encoded audio signal 101 to generate the multichannel signal input for module 150. In some embodiments, the multichannel signal may comprise five separate PCM audio streams and subwoofer channel 157.

In some embodiments, the multichannel signal input may comprise analog signals. In these embodiments, some functions of processing module may be performed with analog circuitry, although the scope of the invention is not limited in this respect.

Figure 2:
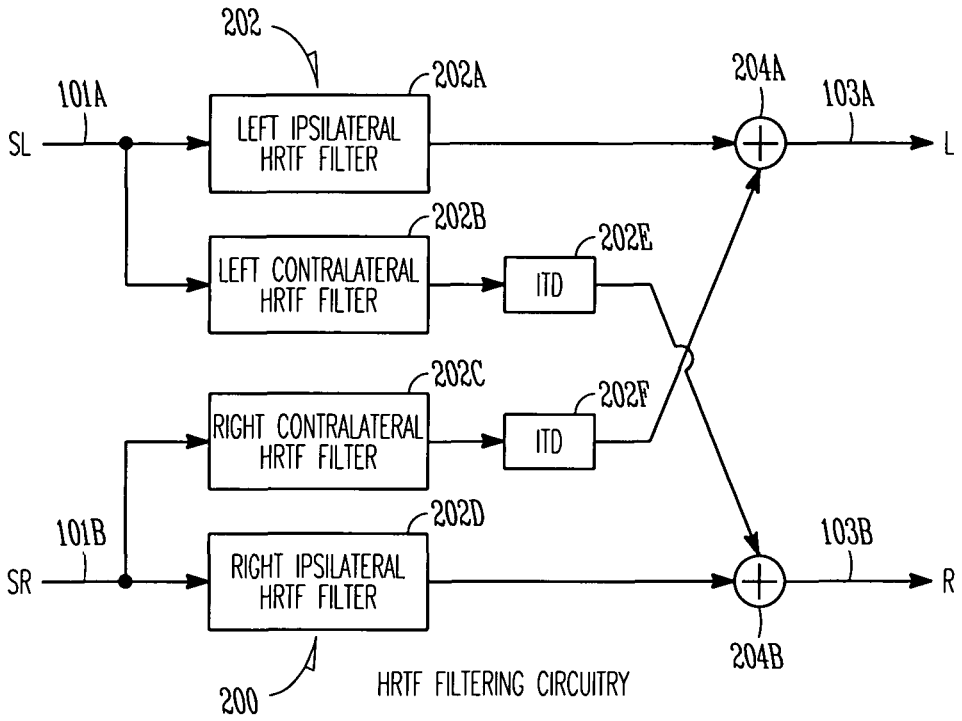
FIG. 2 is a block diagram of head-related transfer function (HRTF) filtering circuitry in accordance with some embodiments of the present invention.

FIG. 2 is a block diagram of HRTF filtering circuitry in accordance with some embodiments of the present invention. HRTF filtering circuitry 200 may be suitable for use as HRTF filtering circuitry 102 (FIG. 1), although other configurations may also be suitable. In some embodiments, HRTF filtering circuitry 200 may include left ipsilateral HRTF filter 202A and left contralateral HRTF filter 202B to operate on surround-left channel signal 101A. HRTF filtering circuitry 200 may also include right contralateral HRTF filter 202C and right ipsilateral HRTF filter 202D to operate on surround-right channel signal 101B. HRTF filtering circuitry 200 may also include right-channel interaural time-delay (ITD) element 202F to delay an output of right contralateral HRTF filter 202C, and left-channel ITD element 202E to delay an output of left contralateral HRTF filter 202B.

Left ipsilateral HRTF filter 202A may simulate a perception that a sound source is at a left-rear perceived location. The left-rear perceived location may be behind and to the left of the predetermined listener location. Left contralateral HRTF filter 202B may simulate a perception that a sound source is at the left-rear perceived location. Right contralateral HRTF filter 202C may simulate a perception that a sound source is at a right-rear perceived location. The right-rear perceived location may be behind and to the right of the predetermined listener location. Right ipsilateral HRTF filter 202D may simulate a perception that a sound source is at the right-rear perceived location.

ITD element 202F may delay an output of right contralateral HRTF filter 202C, and left-channel ITD element 202E may delay an output of left contralateral HRTF filter 202B. ITD elements 202E & 202F may introduce a time-delay based on a distance between a listener's ears, although the scope of the invention is not limited in this respect. Although ITD elements 202E and 202F are illustrated in the signal path after contralateral filters 202B and 202C, this is not a requirement. In other embodiments, ITD elements 202E and 202F may be provided in the signal path before contralateral filters 202B and 202C. In other embodiments, ITD elements 202E and 202F may be encapsulated within contralateral filters 202B and 202C.

HRTF filtering circuitry 200 may also include left channel combining element 204A to combine (e.g., add) signal outputs from left ipsilateral HRTF filter 202A and right-channel ITD element 202F to generate spatially-processed surround channel signal 103A. HRTF filtering circuitry 200 may also include right channel combining element 204B to combine signal outputs from left-channel ITD element 202E and right ipsilateral HRTF filter 202D to generate spatially-processed surround channel signal 103B.

Figure 3:
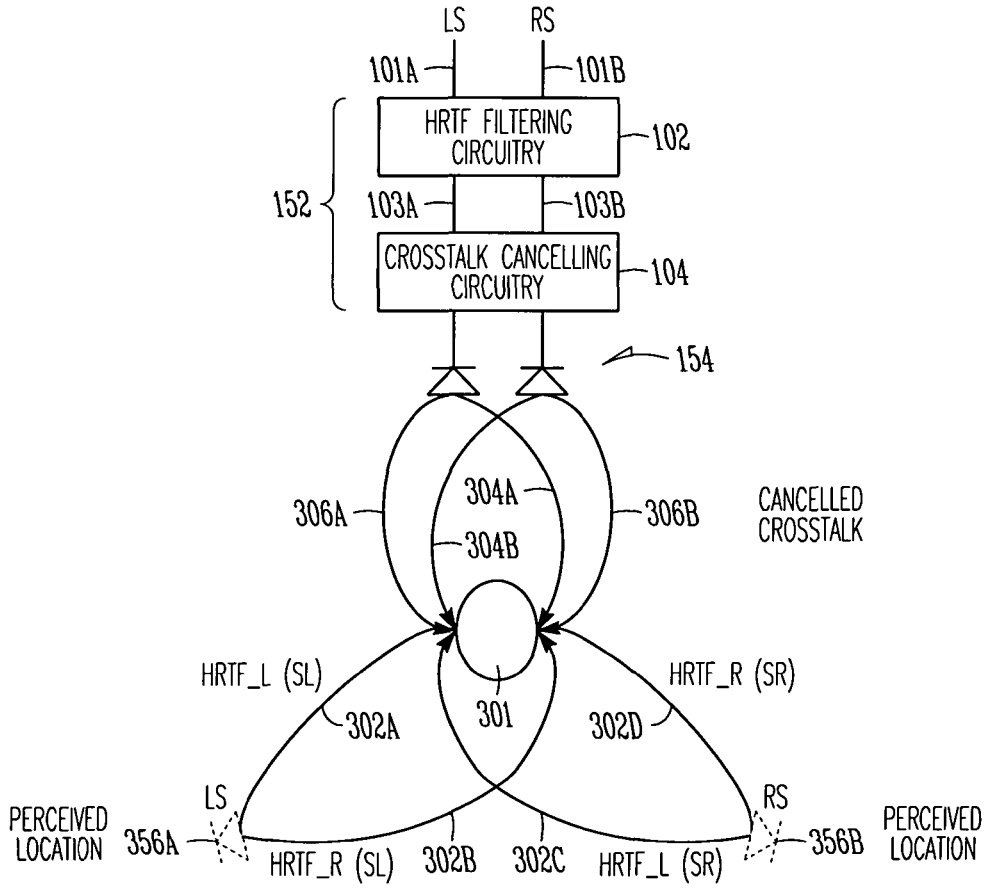
FIG. 3 illustrates crosstalk cancellation and virtualization in accordance with some embodiments of the present invention.

FIG. 3 illustrates crosstalk cancellation and virtualization in accordance with some embodiments of the present invention. HRTF filtering circuitry 102 may generate spatially-processed surround channel signals 103A & 103B that may simulate the perception that a sound source is behind predetermined listener location 301. Crosstalk cancellation circuitry 104 may reduce and/or substantially cancel crosstalk for predetermined listener location 301. HRTF filtering circuitry 102 may correspond to HRTF filtering circuitry 102 (FIG. 1) and crosstalk cancellation circuitry 104 may correspond to crosstalk cancellation circuitry 104 (FIG. 1). In FIG. 3, signal combining circuitry 106 (FIG. 1) is not illustrated for clarity.

Signal paths 304A and 304B illustrate crosstalk that may be reduced and/or substantially canceled by crosstalk cancellation circuitry 104 while preserving/equalizing signal paths 306A and 306B. Signal paths 302A through 302D illustrate the signal paths that the various filters of HRTF filtering circuitry 102 may simulate.

Referring to FIGS. 1, 2 and 3, left ipsilateral HRTF filter 202A may have a transfer function selected to generate signals associated with signal path 302A. This may simulate the perception that a sound source is at left-rear perceived location 356A, which may be behind and to the left of predetermined listener location 301. Left contralateral HRTF filter 202B may have a transfer function selected to generate signals associated with signal path 302B. This may simulate a perception that a sound source is at left-rear perceived location 356A. Right contralateral HRTF filter 202C may have a transfer function selected to generate signals associated with signal path 302C. This may simulate a perception that a sound source is at right-rear perceived location 356B, which may be behind and to the right of predetermined listener location 301. Right ipsilateral HRTF filter 202D may have a transfer function selected to generate signals associated with signal path 302D. This may simulate a perception that a sound source is at right-rear perceived location 356B.

The operation of HRTF filtering circuitry 200 is not limited to simulating the perception that sound sources are behind a listener, as other sound-source locations are equally suitable. For example, in some other embodiments, the transfer functions of left ipsilateral HRTF filter 202A, left contralateral HRTF filter 202B, right contralateral HRTF filter 202C, and right ipsilateral HRTF filter 202D may be selected to simulate a perception that sound sources are at other locations (e.g., to the sides and/or more toward the front of a listener).

In some embodiments, the transfer functions of HRTF filters 202A-202D may implement frequency-dependent time delays and frequency-dependent gains. In some embodiments, the transfer functions of HRTF filters 202A-202D may be based on measurements of HRTFs at predetermined listener location 301, although the scope of the invention is not limited in this respect. In some embodiments, the transfer functions of HRTF filters 202A-202D may also be based on the configuration of speaker 154, including the spacing between speaker drivers 154A and 154B, although the scope of the invention is not limited in this respect.

In some embodiments, the transfer function of left ipsilateral HRTF filter 202A may be identical to the transfer function of right ipsilateral HRTF filter 202D. The transfer function of left contralateral HRTF filter 202B may be symmetrical to the transfer function of right contralateral HRTF filter 202C, although the scope of the invention is not limited in this respect.

In some embodiments, crosstalk cancellation circuitry 104 may comprise one or more filters having transfer functions selected to cancel crosstalk components associated with signal path 304B from spatially-processed surround channel signal 103B that would arrive at the listener's left ear. Crosstalk cancellation circuitry 104 may also comprise one or more filters having transfer functions selected to cancel crosstalk components associated with signal path 304A from spatially-processed surround channel signal 103A that would arrive at the listener's right ear. In some embodiments, the transfer functions of the filters of crosstalk cancellation circuitry 104 may be based on the configuration of speaker 154, including the spacing between speaker drivers 154A and 154B. In these embodiments, left channel signal may be perceived at the left ear through signal path 306A, and the right channel signal may be perceived at the right ear through signal path 306B. When crosstalk is cancelled, the right channel signal is generally not perceived at the left ear through signal path 304B, and the left channel signal is generally not perceived at the right ear through signal path 304A. In some embodiments, HRTF processing and crosstalk cancellation may be performed by a single filtering element, although the scope of the invention is not limited in this respect.

Through the virtualization of surround-left and surround-right channel signals 101A & 101B, and through the cancellation of crosstalk, a listener at location 301 may perceive surround-left channel signal 101A from location 356A and may perceive surround-right channel signal 101B from location 356B.

FIG. 4 is a block diagram of a virtual surround-sound system in accordance with some other embodiments of the present invention. Virtual surround-sound system 400 virtualizes the surround channels and selectively virtualizes the left and right front channels to provide a surround-sound experience without separate surround-channel speakers and, in some cases, without separate front-left and right speakers.

Virtual surround-sound system 400 may comprise processing module 450 which receives a multichannel input and generates spatially-processed signals 407A & 407B for first and second drivers of center speaker 454. Spatially-processed signals 407A & 407B may include center-channel components, may virtualize the surround channels, and may virtualize the front-left and front-right channels, when played through center speaker 454.

The multichannel input may comprise at least surround-left (SL) and surround-right (SR) channel signals 401A & 401B, front-left (FL) and front-right (FR) channel signals 451A & 451B, the center (C) channel signal 451C. In some embodiments, the multichannel input may be generated by decoder 412 from encoded audio signal 401. In some embodiments, decoder 412 may be part of processing module 450, although the scope of the invention is not limited in this respect. In some embodiments, multichannel input may also comprise subwoofer signal 437.

Processing module 450 may comprise spatial processor 430 to spatially process surround-left and surround-right channel signals 401A & 401B and front-left and front-right channel signals 451A & 451B. Spatial processor may also combine the spatially-processed signals for providing to drivers of center speaker 454 after crosstalk cancellation and combining with center-channel signal 451C.

Processing module 450 may also include front-virtualization control circuitry 434 to cause spatial processor 430 to refrain from spatially processing front-left and front-right channel signals 451A & 451B when front-left and front-right channel signals 451A & 451B are provided to front-left and front-right speakers. In these embodiments, processing module 450 may automatically convert between operating as a 1.1 virtual surround-sound system and a 3.1 virtual surround-sound system. In these embodiments, when front-left and/or front-right speakers are not used, the audio outputs of center speaker 454 may virtualize the surround-left and/or surround-right channels as well as the front-left and front-right channels operating as a 1.1 virtual surround-sound system. When front-left and front-right speakers are used, the audio outputs of center speaker 454 may virtualize only the surround-left and surround-right channels operating as a 3.1 virtual surround-sound system. In some embodiments, when one front speaker is connected (e.g., the front-left speaker) and the other front speaker is not connected (e.g., the front right-speaker), the other front speaker (e.g., the front-right speaker) may be virtualized.

In some embodiments, spatial processor 430 comprises surround-channel spatial-processing circuitry 402 to spatially process surround-left and surround-right channel signals 401A & 401B. Spatial processor 430 also comprises front-channel spatial-processing circuitry 456 to spatially process front-left and front-right channel signals 451A & 451B. Signal combining circuitry 458 may combine outputs from both surround-channel spatial-processing circuitry 402 and front-channel spatial-processing circuitry 456 to generate spatially-processed signals 403A & 403B for providing to drivers of center speaker 454.

Front-virtualization control circuitry 434 may selectively cause front-channel spatial-processing circuitry 456 to refrain from generating spatially-processed front-left and front-right channel signals 457 when separate front-left and front-right speakers are connected to processing module 450 (i.e., separate from center speaker 454). In these embodiments, spatially-processed signals 403A & 403B may include spatially-processed surround channel signals 405. Spatially-processed signals 403A & 403B may also include spatially-processed front channel signals 457 when front-channel spatial processing is selected by front-virtualization control circuitry 434.

In some embodiments, processing module 450 may include front-left speaker port 453A and front-right speaker port 453B. Front-virtualization control circuitry 434 may be configured to automatically disable operation of front-channel spatial-processing circuitry 456 when front-left and front-right speakers are connected to ports 453A & 453B.

In some embodiments, front-virtualization control circuitry 434 may include load-sensing circuitry to determine when front-left and front-right speakers are connected to ports 453A & 453B, although the scope of the invention is not limited in this respect as other techniques may be utilized by front-virtualization control circuitry 434 to determine when speakers are connected to ports 453A & 453B. In some of these embodiments, when speakers are removed from ports 453A & 453B, front-channel spatial-processing circuitry 456 may perform spatial processing on front-left and front-right channel signals 451A & 451B.

In some embodiments, processing module 450 may include switch 455 which may be selectable by a user or listener to cause front-virtualization control circuitry 434 to either enable or disable operation of front-channel spatial-processing circuitry 456. In these embodiments, the user or listener may select the position of switch 455 to disable operation of front-channel spatial-processing circuitry 456 when front-left and front-right speakers are connected to ports 453A & 453B. The user or listener may select the position of switch 455 to enable operation of front-channel spatial-processing circuitry 456 when front-left and front-right speakers are not connected to ports 453A & 453B. Switch 455 may be included when automatic sensing of front-left and front-right speakers is not performed.

Spatially-processed surround channel signals 405 may be generated to simulate a perception that a surround-left sound source is located behind and to the left of a listener location and to simulate a perception that a surround-right sound source is located respectively behind and to the right of the listener location. Spatially-processed front channel signals 457 may be generated to simulate a perception that a front-left sound source is located in front of and to the left of the listener location and to simulate a perception that a front-right sound source is located in front of and to the right of the listener location.

Processing module 450 may also include crosstalk cancellation circuitry 404 to substantially remove and or cancel components comprising crosstalk from spatially-processed signals 403A & 403B for a predetermined listener location.

Processing module 450 may also include center-channel signal combining circuitry 406 to add spatially-processed signals 403A & 403B after the crosstalk cancellation to center-channel signal 451C to generate spatially-processed signals 407A & 407B.

Decoder 412 may generate the multichannel input from encoded audio signal 401. Encoded audio signal 401 may comprise perceptually encoded and/or compressed audio, such as an MP3 encoded signal. Decoder 412 may decode and/or expand encoded audio signal 401 to generate surround-left and surround-right channel signals 401A & 401B, front-left and front-right channel signals 451A & 451B, center-channel signal 451C, and/or subwoofer signal 437.

System 400 may also include digital-to-analog converters (DACs) not illustrated for use in converting signals 407A, 407B, 451A, and 451B to analog signals. System 400 may include audio amplifiers not illustrated to amplify signals 407A, 407B, 451A, and 451B prior to the speakers. In some embodiments, the audio amplifiers and/or DACs may be part of the processing module 450, while in other embodiments, the audio amplifiers and/or DACs may be part of the speakers. In some embodiments, class-D type amplifiers may be used which perform the function of the DACs.

In some embodiments, surround-channel spatial-processing circuitry 402 may include left-surround ipsilateral HRTF filter (HRTF_L (SL)) 402A and left-surround contralateral HRTF filter (HRTF_R (SL)) 402B to operate on surround-left channel signal 401A. Surround-channel spatial-processing circuitry 402 may also include right-surround contralateral HRTF filter (HRTF_L (SR)) 402C and right-surround ipsilateral HRTF filter (HRTF_R (SR)) 402D to operate on surround-right channel signal 401B. Surround-channel spatial-processing circuitry 402 may also include right-channel ITD element 402F to delay an output of right-surround contralateral HRTF filter 402C, and left-channel ITD element 402E to delay an output of left-surround contralateral HRTF filter 402B.

In some embodiments, front-channel spatial-processing circuitry 456 may include left-front ipsilateral HRTF filter (HRTF_L (FL)) 456A and left-front contralateral HRTF filter (HRTF_R (FL)) 456B to operate on front-left channel signal 451A. Front-channel spatial-processing circuitry 456 may also include right-front contralateral HRTF filter (HRTF_L (FR)) 456C and right-front ipsilateral HRTF filter (HRTF_R (FR)) 456D to operate on front-right channel signal 451B. Front-channel spatial-processing circuitry 456 may also include right-channel ITD element 456F to delay an output of the right-front contralateral HRTF filter 456C, and left-channel ITD element 456E to delay an output of the left-front contralateral HRTF filter 456B.

Although processing module 150 (FIG. 1) and processing module 450 (FIG. 4) are illustrated as having several separate functional elements, one or more of the functional elements may be combined and may be implemented by combinations of software-configured elements, such as processing elements including digital signal processors (DSPs), and/or other hardware elements. For example, some elements may comprise one or more microprocessors, DSPs, application specific integrated circuits (ASICs), radio-frequency integrated circuits (RFICs) and combinations of various hardware and logic circuitry for performing at least the functions described herein. In some embodiments, the elements of processing module 150 (FIG. 1) and/or processing module 450 (FIG. 4) may refer to one or more processes operating on one or more processing elements.

Although encoded audio signals 101 (FIG. 1) and 401 (FIG. 4) are described above as having components of five channels and one subwoofer channel (i.e., being provided from a 5.1 device), the scope of the invention is not limited in this respect as the present invention is equally applicable to virtualizing channels of encoded audio signals having a greater number of channels (e.g., provided by an N.1 device). For example, encoded audio signals 101 (FIG. 1) and 401 (FIG. 4) may have components of seven channels and one subwoofer channel and may be provided from a 7.1 device. In these embodiments, additional block of spatial-processing circuitry similar to spatial-processing circuitry 402 (FIG. 1) or spatial-processing circuitry 446 (FIG. 1) may be provided to virtualize two, four, six, or more channels. In some embodiments, the virtualization of these additional channels may be performed using the center speaker when speakers for the additional channels are not detected.

Unless specifically stated otherwise, terms such as processing, computing, calculating, determining, displaying, or the like, may refer to an action and/or process of one or more processing or computing systems or similar devices that may manipulate and transform data represented as physical (e.g., electronic) quantities within a processing system's registers and memory into other data similarly represented as physical quantities within the processing system's registers or memories, or other such information storage, transmission or display devices. Furthermore, as used herein, a computing device includes one or more processing elements coupled with computer-readable memory that may be volatile or non-volatile memory or a combination thereof.

Embodiments of the invention may be implemented in one or a combination of hardware, firmware, and software. Embodiments of the invention may also be implemented as instructions stored on a machine-readable medium, which may be read and executed by at least one processor to perform the operations described herein. A machine-readable medium may include any mechanism for storing or transmitting information in a form readable by a machine (e.g., a computer). For example, a machine-readable medium may include read-only memory (ROM), random-access memory (RAM), magnetic disk storage media, optical storage media, flash-memory devices, and others.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A processing module for a virtual-sound system configured to convert between virtual sound system operational modes, the processing module comprising:

a spatial processor configured to receive a surround-left channel signal, a surround-right channel signal, a front-left channel signal, and a front-right channel signal from a decoder and to spatially process the received surround-left channel signal, surround-right channel signal, front-left channel signal, and front-right channel signal to generate spatially-processed signals, the generated spatially-processed signals comprising a virtualized front-left audio signal based on the received front-left channel signal and a virtualized front-right audio signal based on the received front-right channel signal, the spatial processor comprising a front-channel spatial-processing circuitry having at least one head-related transfer function filter to process the received front-left channel signal and the received front-right channel signal;

a circuitry, coupled to the spatial processor, configured to receive the spatially-processed signals generated by the spatial processor, to generate separate signals for a first driver and a second driver of a center channel array in a single center speaker unit by removing crosstalk from the received spatially-processed signals and adding a center channel signal to the received spatially-processed signals after the removing of the crosstalk from the received spatially-processed signals, and to provide the generated separate signals to the first driver and the second driver of the center channel array in the single center speaker unit; and a front-virtualization control circuitry, coupled to the decoder and the spatial processor, configured to provide the front-left channel signal and the front-right channel signal from the decoder to the spatial processor and to cause:

the spatial processor to selectively refrain from the spatially processing of the received front-left channel signal, including the at least one head-related transfer function filter processing of the received front-left channel signal, based on a detection of an electrical connection from the front-virtualization control circuitry to a front-left speaker and to inhibit providing the virtualized front-left audio signal from the spatial processor to one of the first driver and the second driver of the center channel array in the single center speaker unit, and the spatial processor to selectively refrain from the spatially processing of the received front-right channel signal, including the at least one head-related transfer function filter processing of the received front-right channel signal, based on a detection of an electrical connection from the front-virtualization control circuitry to a front-right speaker and to inhibit providing the virtualized front-right audio signal from the spatial processor to other one of the first driver and the second driver of the center channel array in the single center speaker unit.

2. The processing module of claim 1 wherein the spatial processor comprises:

a surround-channel spatial-processing circuitry configured to spatially process the received surround-left and surround-right channel signals and generate spatially-processed surround channel signals;

a signal combining circuitry configured to combine outputs from both the surround-channel spatial-processing circuitry and the front-channel spatial-processing circuitry to generate first and second spatially-processed combined signals, wherein the circuitry to generate the separate signals for the first and second drivers of the center channel array in the single center speaker unit adds the center-channel signal to the spatially-processed signals.

3. The processing module of claim 1 further comprising a front-left speaker port and a front-right speaker port, wherein the front-virtualization control circuitry is configured to disable operation of at least a portion of the front-channel spatial-processing circuitry when at least one of the front-left and front-right speakers are connected to one of the front-left speaker and the front-right speaker ports, respectively.

4. The processing module of claim 3 wherein the front-virtualization control circuitry includes at least one of:

a load-sensing circuitry to determine when at least one of the front-left and front-right speakers is connected to the one of the front-left speaker and the front-right speaker ports; or a switch selectable by a user to cause the front-virtualization control circuitry to either enable or disable the operation of the at least portion of the front-channel spatial-processing circuitry.

5. The processing module of claim 2 wherein the spatially-processed surround channel signals are generated to simulate a perception that a surround-left sound source is located behind and on the left of a listener location and to simulate a perception that a surround-right sound source is located respectively behind and on the right of the listener location when the spatially-processed surround channel signals are transmitted as audio signals by the first and second drivers after the removing of the crosstalk, and wherein the virtualized front-left audio signal is generated to simulate a perception that a front-left sound source is located in front of and on the left of the listener location and the virtualized front-right audio signal is generated to simulate a perception that a front-right sound source is located in front of and on the right of the listener location when the virtualized front-left and virtualized front-right audio signals are transmitted as audio signals by the first and second drivers after the removing of the crosstalk.

6. The processing module of claim 2 wherein the circuitry to generate separate signals for the first and second drivers of the center channel array in the single center speaker unit comprises:

a crosstalk cancellation circuitry to substantially remove a crosstalk from the first and second spatially-processed combined signals for a predetermined listener location; and a center-channel signal combining circuitry to add the center-channel signal to the first and second spatially-processed combined signals for the first and second drivers of the center channel array in the single center speaker unit, wherein the processing module is configured to receive a multichannel input comprising at least the surround-left and surround-right channel signals, the front-left and front-right channel signals, and the center-channel signal.

7. The processing module of claim 6 wherein the decoder generates the multichannel input from an encoded audio signal.

8. The processing module of claim 2 wherein the surround-channel spatial-processing circuitry comprises:

a left ipsilateral head-related transfer function (HRTF) filter and a left contralateral HRTF filter to operate on the surround-left channel signal;

a right contralateral HRTF filter and a right ipsilateral HRTF filter to operate on the surround-right channel signal;

a right-channel interaural time-delay (ITD) element to delay an output of the right contralateral HRTF filter; and a left-channel interaural time-delay element to delay an output of the left contralateral HRTF filter, and wherein the front-channel spatial-processing circuitry comprises:

a left ipsilateral head-related transfer function (HRTF) filter and a left contralateral HRTF filter to operate on the front-left channel signal;

a right contralateral HRTF filter and a right ipsilateral HRTF filter to operate on the front-right channel signal;

a right-channel interaural time-delay (ITD) element to delay an output of the right contralateral HRTF filter of the front-channel spatial-processing circuitry; and a left-channel interaural time-delay element to delay an output of the left contralateral HRTF filter of the front-channel spatial-processing circuitry.

9. The processing module of claim 1 wherein the center channel array in the single center speaker unit comprises a stereo-dipole speaker, wherein the first and second drivers of the center channel array in the single center speaker unit are adjacent to each other and separated by a distance, and wherein the first and second drivers of the center channel array in the single center speaker unit are to be directed in a forward direction to better achieve a crosstalk cancellation and a virtualization of at least the surround-left and surround-right channel signals.

10. The processing module of claim 1 wherein the circuitry to generate the separate signals for the first and second drivers of the center channel array in the single center speaker unit adds the center channel signal to the spatially-processed signals, and wherein the processing module further comprises an amplifier to reduce a signal level of the center channel signal prior to the addition to the spatially-processed signals.

11. A method comprising:

receiving a surround-left channel signal, a surround-right channel signal, a front-left channel signal, and a front-right channel signal from a decoder;

spatially processing, by a spatial processor including a front channel spatial-processing circuitry performing at least one head-related transfer function filter processing, the received surround-left channel signal, surround-right channel signal, front-left channel signal, and front-right channel signal to generate spatially-processed signals, the generated spatially-processed signals comprising a virtualized front-left audio signal based on the received front-left channel signal and a virtualized front-right audio signal based on the received front-right channel signal, the spatially processing comprising a front channel spatial-processing including at least one head-related transfer function filter processing by the front channel spatial-processing circuitry to process the received front-left channel signal and the received front-right channel signal;

generating, by a circuitry, separate signals for a first driver and a second driver of a center channel array in a single center speaker unit by removing crosstalk from the received spatially-processed signals and adding a center channel signal to the received spatially-processed signals after the removing of the crosstalk from the received spatially-processed signals, and to provide the generated separate signals to the first driver and the second driver of the center channel array in the single center speaker unit;

refraining the front-virtualization control circuitry from spatially processing, including the at least one head-related transfer function filter processing, the received front-left channel signal, and from generating the virtualized front-left audio signal in the generated spatially-processed signals in response to a detection of an electric connection from the front-virtualization control circuitry to a front-left speaker and to inhibit the first driver from providing a virtualized front-left audio through the center channel array in the single center speaker unit; and refraining the front-virtualization control circuitry from spatially processing, including the at least one head-related transfer function filter processing, the received front-right channel signal and from generating the virtualized front-right audio signal in the generated spatially-processed signals in response to a detection of an electric connection from the front-virtualization control circuitry to a front-right speaker and to inhibit the second driver from providing a virtualized front-right audio through the center channel array in the single center speaker unit.

12. The method of claim 11 further comprising either:

determining when at least one of the front-left and front-right speakers are connected to the front virtualization control circuitry by sensing a load of at least one of the front-left and front-right speakers; or enabling or disabling at least a portion of the front channel spatial-processing in response to an input from a user.

13. The method of claim 11 wherein the generated spatially-processed signals further including a spatially-processed surround channel signals and wherein the spatially-processed surround channel signals are generated to simulate a perception that a surround-left sound source is located behind and on the left of a listener location and to simulate a perception that a surround-right sound source is located respectively behind and on the right of the listener location when the spatially-processed surround channel signals are transmitted as audio signals by the first and second drivers after the removing of the crosstalk.

14. The method of claim 11 wherein the virtualized front-left and front-right audio signals are generated to simulate a perception that a front-left sound source is located in front of and on the left of a listener location and to simulate a perception that a front-right sound source is located in front of and on the right of the listener location when the virtualized front-left and front-right audio signals are transmitted as audio signals by the first and second drivers of the center channel array in the single center speaker unit after the removing of the crosstalk.

15. The method of claim 11 further comprising enabling the spatially processing of the front-left and front-fight channel signals in response to de-coupling of at least one of the front-left and front-right speakers.

16. The method of claim 11 further comprising reducing a signal level of the center channel signal prior to the adding to the received spatially-processed signals.

* * * * *